US011583884B2

(12) United States Patent
Perez-Aguayo

(10) Patent No.: US 11,583,884 B2
(45) Date of Patent: Feb. 21, 2023

(54) FUNNEL-BOTTOMED PAINT BUCKET

(71) Applicant: Jesus Perez-Aguayo, Wichita, KS (US)

(72) Inventor: Jesus Perez-Aguayo, Wichita, KS (US)

( * ) Notice: Subject to any disclaimer, the term of this patent is extended or adjusted under 35 U.S.C. 154(b) by 0 days.

(21) Appl. No.: 15/811,808

(22) Filed: Nov. 14, 2017

(65) Prior Publication Data

US 2021/0213481 A1 Jul. 15, 2021

Related U.S. Application Data

(60) Provisional application No. 62/421,655, filed on Nov. 14, 2016.

(51) Int. Cl.

| | |
|---|---|
| ***B05B 15/00*** | (2018.01) |
| ***B05B 15/30*** | (2018.01) |
| ***B67D 7/68*** | (2010.01) |
| ***B67D 7/02*** | (2010.01) |
| ***B05C 11/10*** | (2006.01) |

(52) U.S. Cl.

CPC ..... *B05B 15/30* (2018.02); *B05C 11/10* (2013.01); *B67D 7/0277* (2013.01); *B67D 7/68* (2013.01)

(58) Field of Classification Search

CPC ..... B65D 21/023; B65D 21/0231; B65D 21/261; B65D 83/32; B65D 1/0261; B05B 9/00–0894; B05B 15/30; B05B 15/33; B05D 11/10; B67D 7/0277; B67D 7/68; B05C 11/10

USPC ..... 222/321.5, 464.7

See application file for complete search history.

(56) References Cited

U.S. PATENT DOCUMENTS

| | | | | |
|---|---|---|---|---|
| 5,749,500 | A * | 5/1998 | Kraus | B65D 25/02 222/377 |
| D890,459 | S * | 7/2020 | Fischer | D32/54 |
| 2001/0004985 | A1* | 6/2001 | Pertschi | B05B 9/03 220/570 |
| 2011/0108580 | A1* | 5/2011 | Koh | B05B 15/30 222/377 |
| 2013/0299506 | A1* | 11/2013 | Chavez | B65D 25/32 220/600 |
| 2014/0117027 | A1* | 5/2014 | Ulstad | B65D 1/40 220/600 |

* cited by examiner

*Primary Examiner* — Nicolas A Arnett

(74) *Attorney, Agent, or Firm* — Kutak Rock LLP

(57) ABSTRACT

A paint bucket may have a funnel shaped bottom to collect paint into a recess while a powered painting system draws paint from the bucket for application to a surface. The recess may receive an intake nozzle from the powered painting system. An insert may create a funnel shaped bottom and recess in a standard flat bottomed bucket.

13 Claims, 6 Drawing Sheets

FUNNEL-BOTTOMED PAINT BUCKET

This application claims the benefit of provisional patent application Ser. No. 62/421,655, entitled "FUNNEL-BOTTOMED PAINT BUCKET," filed on Nov. 14, 2016, which is incorporated herein by reference.

FIELD OF INVENTION

The present invention relates to paint buckets. More particularly, the present invention relates to a paint bucket with funnel-shaped bottom.

BACKGROUND AND DESCRIPTION OF THE RELATED ART

While many homeowners paint their houses using manual brushes and/or rollers, manual painting is a time consuming process. Commercial painters and many homeowners often prefer to use powered painting tools. Powered painting tools may draw paint from a bucket or other large container using a suction or vacuum system and then apply the paint to a surface using a sprayer, roller, or other application device. In such a fashion, a uniform flow of paint to a surface may be attained and the painter need not interrupt paint application to periodically apply paint to a brush or roller. By using a vacuum or suction system to draw paint from the container, considerable time, effort, and energy of the painter may be saved while often achieving a superior result.

SUMMARY OF THE INVENTION

While powered painting systems save considerable labor relative to manual painting while producing superior results, the use of powered painting systems is not without challenges. One particular challenge to using an automated painting system is that the final portions of paint within a container may be difficult to withdraw using the vacuum system. As the paint level within a bucket or other container lowers, the intake nozzle of the powered painting system may encounter difficulty when the paint level is at or below the intake aperture(s) of the nozzle. When the paint level falls below such a level, air may be drawn into the powered painting system, which may produce air bubbles within the power painter's supply line that may cause splattering or other undesired effects during the paint application process. Because typical paint buckets have relatively large diameters relative to the size of the intake nozzle of a powered painting system, a substantial volume of paint may remain in a bucket when the paint level has been reduced to a problematic height. Using the final portion of paint within a bucket, such as the last pint of paint within a conventional five-gallon bucket, may be difficult. While the remaining paint may still be drawn into the nozzle of a power painting system by manually tilting the bucket to collect the paint at the resulting lower edge while the bucket is held at an incline, such a practice requires additional labor by the painter and further requires that the painter be extremely attentive to the level of paint remaining in a bucket. Of course, in some examples the paint remaining at the bottom of a bucket that cannot be readily extracted by a power painting nozzle may simply be discarded, which is both economically wasteful and environmentally undesirable.

The present invention provides funnel shaped bottoms for paint buckets and paint buckets with such funnel-shaped bottoms. The funnel shape may cause paint within the bucket to flow down the angled wall(s) of the funnel to a recess for uptake by the powered painting system. The recess may temporarily retain the intake nozzle of a power painter. By retaining the intake nozzle within the recess where the funnel-shaped bottom gathers the final portion of paint within the bucket, the extraction of the final portion of paint from within the bucket is simplified. The recess may have various geometries, such as cylindrical or conical, to facilitate the temporary retention of a power painter intake nozzle within the recess. The recess of the funnel shaped bottom may be dimensioned to receive an anticipated power painter nozzle, and may be further dimensioned to permit the rod and/or hose attached to the nozzle to assume one or more desired orientations within the bucket.

The funnel shaped bottom of a paint bucket in accordance with the present invention may be formed as an integral part of a paint bucket or may be provided as an insert that may be used with a pre-existing paint bucket. If provided as an insert, a funnel shaped bottom in accordance with the present invention may use a paint-tight seal, such as a pliable flange of silicone or rubber, to firmly contact and seal with the interior sides of the bucket when the funnel-shaped bottom has been inserted into the interior of the bucket.

BRIEF DESCRIPTION OF THE SEVERAL VIEWS OF THE DRAWINGS

Examples of systems and methods in accordance with the present invention are described in conjunction with the attached drawings, wherein.

DETAILED DESCRIPTION

Figure 1:
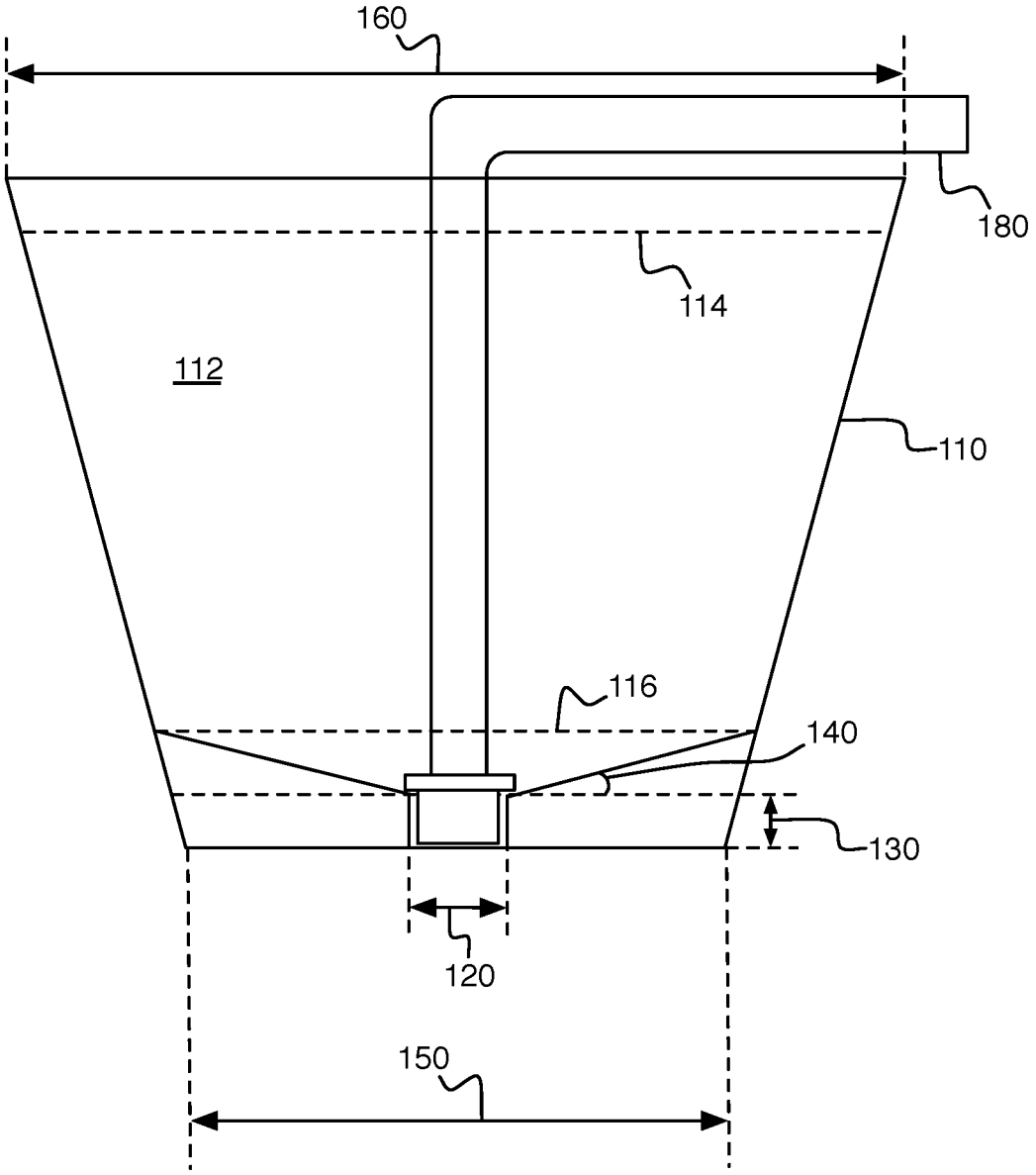
FIG. 1 illustrates a cross-section of an exemplary bucket in accordance with the present invention.

One example of a funnel-bottomed bucket in accordance with the present invention is illustrated in FIG. 1. A paint bucket 110 may comprise an interior 112 that holds a certain volume of paint, for example, a bucket may provide an interior that holds five gallons of paint or other liquid. However, bucket 110 may comprise any size or volume of bucket, whether designed specifically to hold paint or for general use. The bucket 110 may have a top diameter 160 and a bottom diameter 150. If the bucket walls are straight, the top diameter 160 and the bottom diameter 150 may be the same, while if the bucket 110 is flare sided the top diameter 160 may be greater than the bottom diameter 150. A bucket 110 may have a first paint level 114 when full but a second paint level 116 after most of the paint within bucket 110 is consumed by power painting system 180 (described further below). Of course, paint levels other than first paint level 114 and second paint level 116 will exist when buckets in accordance with the present invention are used, and the level may eventually be lower than exemplary second paint level 116, even to the point of being at a level within the recess provided at the bottom of the exemplary bucket 110, which shall be described further below.

Because a relatively small amount of paint may fill the recess containing the nozzle of a sprayer system 180, almost every bit of paint contained within bucket 110 may be used without having to reposition bucket 110 or the nozzle of power painting system 180. A recess, shown in the example of FIG. 1 as cylindrical, may have a diameter of 120 that corresponds to the diameter of a nozzle used by the power painting system 180 to extract paint from the bucket 110. The angled sides of the funnel bottom, which shall be described more fully below, may slope at an angle 140 to cause paint to flow into the recess as the level of paint within the bucket 110 lowers. The top of the recess may correspond with the bottommost edge of the angled side of the funnel bottom. The recess may have a height 130 sufficient to retain the nozzle of a power painting system 180 within the recess.

Figure 2:
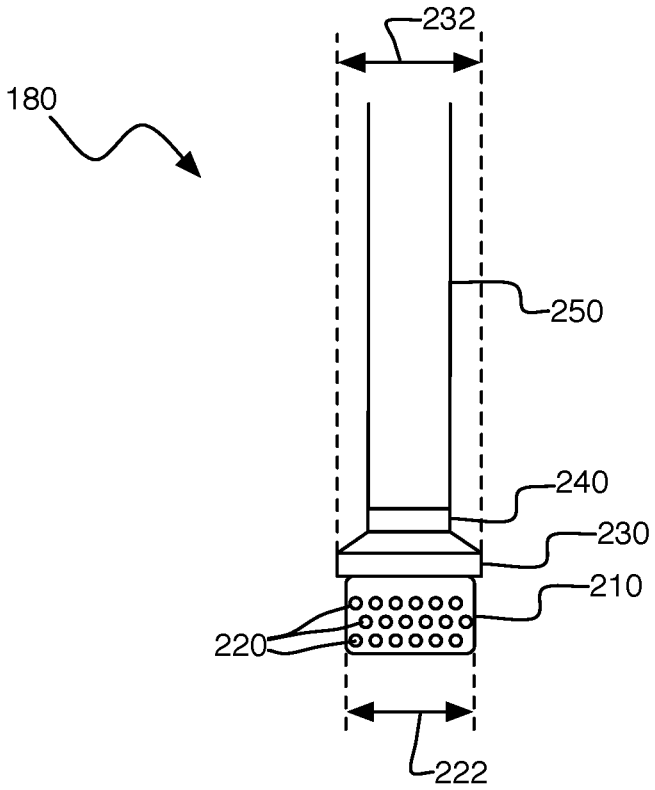
FIG. 2 illustrates an example of an intake nozzle that may be used in conjunction with a bucket in accordance with the present invention.

FIG. 2 illustrates one example of a power painting system 180 having a nozzle 210 that may be used in conjunction with buckets in accordance with the present invention. At least one aperture 220 within nozzle 210 may permit paint to be drawn into nozzle 210 for application by a painter. Screens and/or filters may be provided as part of or in conjunction with nozzle 210 to protect the painting system 180 from debris that may be contained in paint. A rigid pipe 250 may deliver paint to a hose that ultimately delivers paint to a sprayer, roller, or other paint application tool under the control of a powered pump system (not shown). The pipe 250 may be coupled to nozzle 210 using a coupling 240 that affixes pipe 250 to the head 230 of nozzle 210. Nozzle 210 may have a diameter of 222 that is smaller than the diameter 232 of head 230. Diameter 222 of nozzle may be the basis of selecting the diameter of a recess used in a funnel-bottomed bucket in accordance with the present invention.

Figure 3:
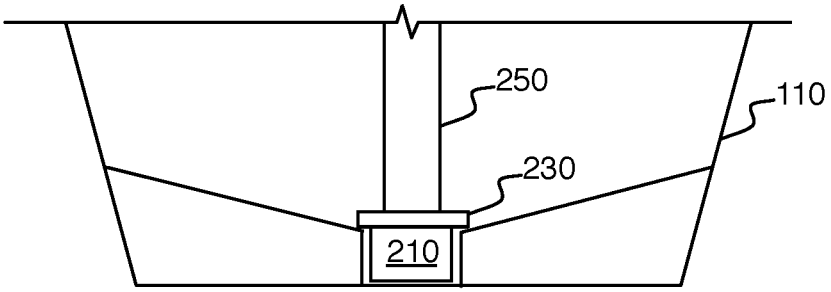
FIG. 3 illustrates an example of an intake nozzle in use with an exemplary bucket in accordance with the present invention.

FIG. 3 illustrates an example of a nozzle 210 inserted into a recess within a funnel-bottomed bucket 110. As can be seen in the example of FIG. 3, the diameter of nozzle 210 is slightly less than the diameter of the recess, permitting nozzle 210 to be snugly but removably inserted into the recess without blocking the flow of paint down the inclined walls of the funnel bottom and into the recess. In some examples, the diameter of the recess may be sufficiently larger than the diameter of nozzle 210 to permit nozzle 210 and pipe 250 to be oriented at an angle other than substantially vertical.

Figure 4A:
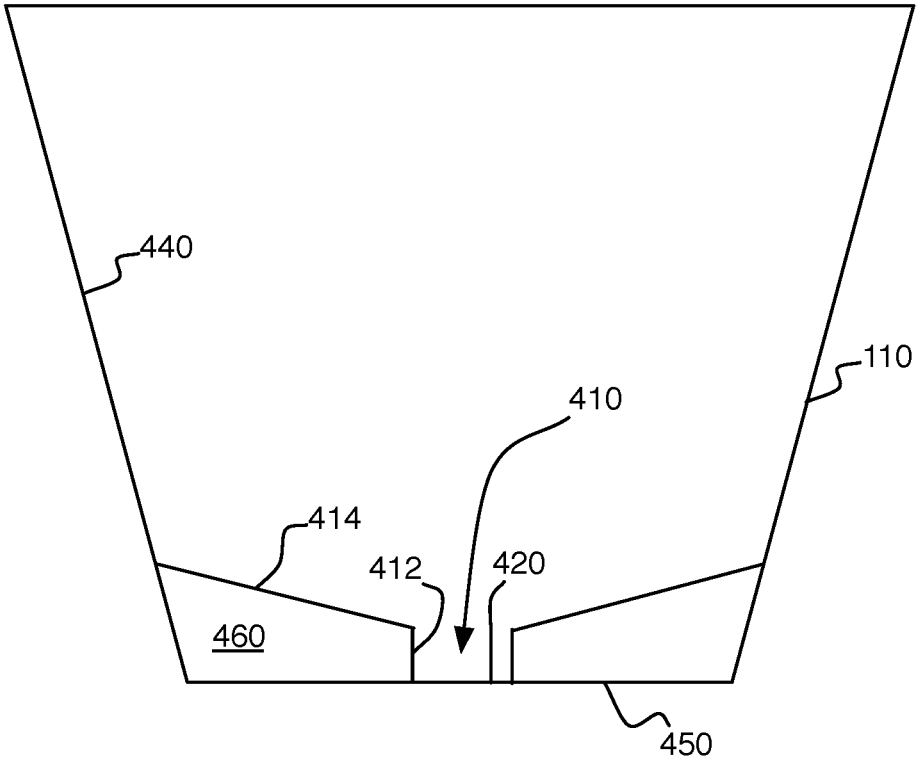
FIGS. 4A and 4B illustrates a further example of a bucket in accordance with the present invention.
Figure 4B:
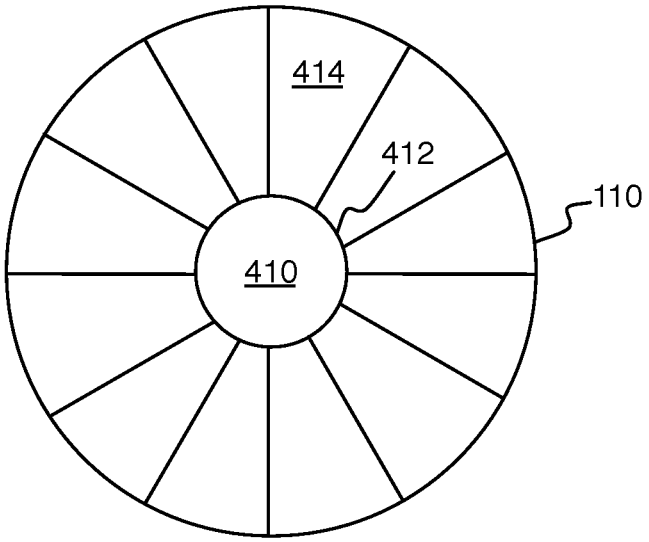

FIGS. 4A and 4B illustrate additional properties of an exemplary recess 410 within a bucket 110. Recess 410 may be defined by a sidewall 412 that extends circularly defining the perimeter of recess 410. Recess 410 may have a bottom 420, with bottom 420 corresponding to the lowest level to which paint within bucket 110 may flow when the bucket 110 is in an upright orientation. Recess 410 may have a cylindrical shape (as depicted in the example of FIG. 4A), a truncated conical shape (as depicted in the example of FIG. 6), or other geometric shapes.

An angled funnel wall 414 may define a funnel having a desired angle to cause paint within bucket 110 to flow into a recess, such as recess 410, as the paint level within bucket 110 reduces. Funnel wall 414 may be configured with an incline of a few degrees to several degrees relative to horizontal, such as between three and forty-five degrees or between five and thirty degrees. A space 460 beneath the angled funnel wall may be solid or hollow, but will not contain paint while the bucket 110 is in use. In some examples, funnel wall(s) and/or recesses may be created within a pre-existing bucket using an insert that may be engaged in the bottom of a bucket having a flat bottom.

Figure 5:
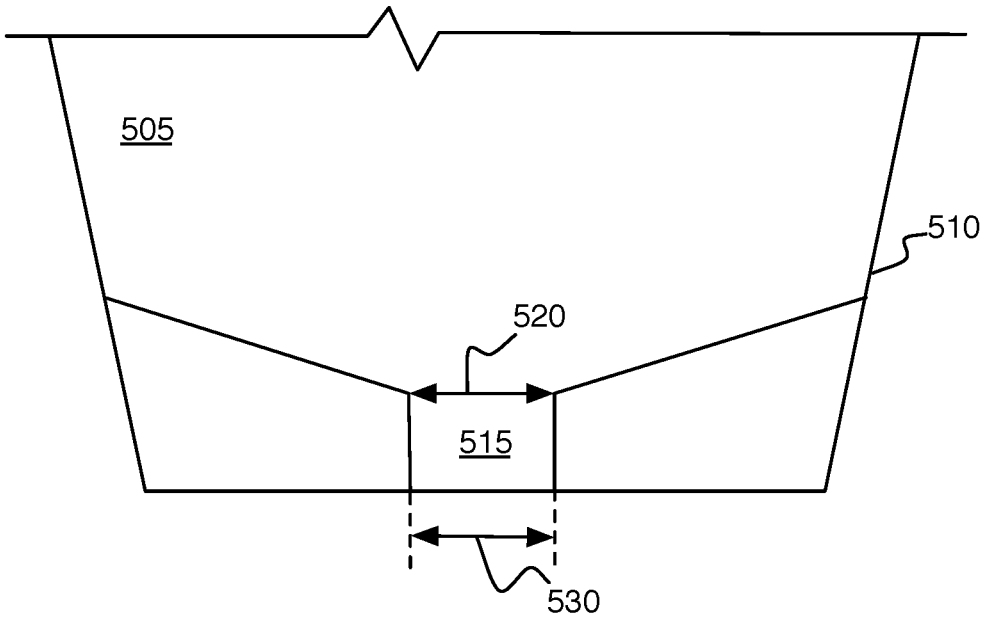
FIG. 5 illustrates a further example of a bucket in accordance with the present invention.

Referring now to FIG. 5, further aspects of an exemplary funnel-bottomed bucket 510 that may hold paint within its interior 505 in accordance with the present invention is illustrated. A recess 515 at the bottom of a funnel shape may be cylindrical in shape. By being cylindrical in shape, recess 515 may possess a top diameter 520 equal to its bottom diameter 530.

Figure 6:
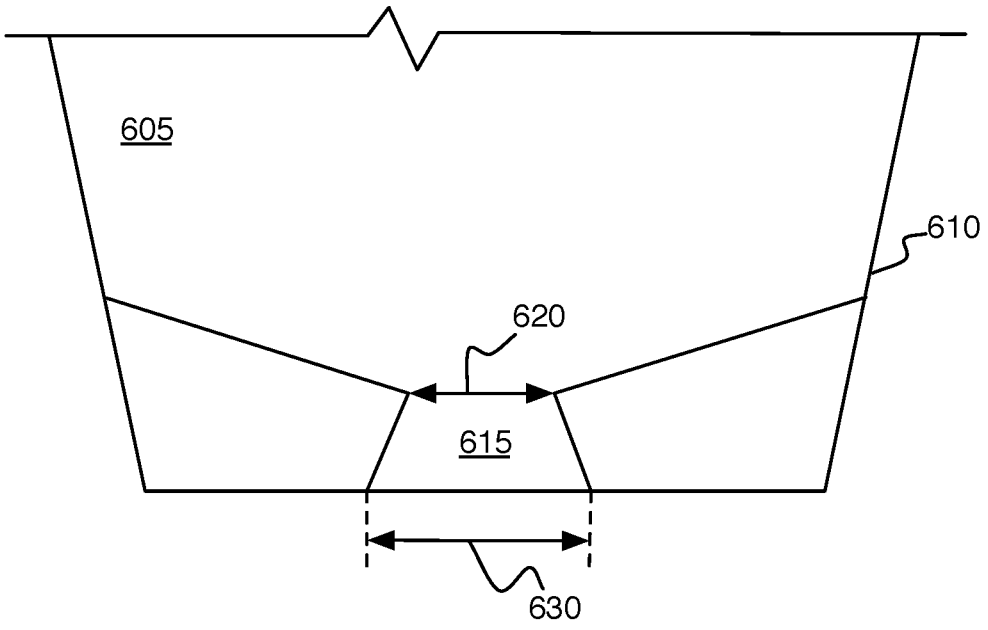
FIG. 6 illustrates a further example of a bucket in accordance with the present invention.

Meanwhile, FIG. 6 illustrates an example of a bucket 610 having an interior 605 to retain a volume of paint wherein the recess 615 has a partially conical shape, i.e. a truncated cone. Recess 615 has a conical shape in the sense that top diameter 620 is smaller than bottom diameter 630 of recess 615. In examples, top diameter 620 may be slightly greater than the anticipated diameter of an intake nozzle of a power painting system. By flaring out at the bottom, recess 615 may receive a nozzle inserted past the top of the recess 615 and permit the nozzle assembly to tilt or lean within recess 615 while the power painter is in use. By leaning the nozzle and pipe of a power painting system, the bucket and/or power painting system may be less likely to tip due to the pulls or tugs that may naturally occur during the painting process.

Figure 7:
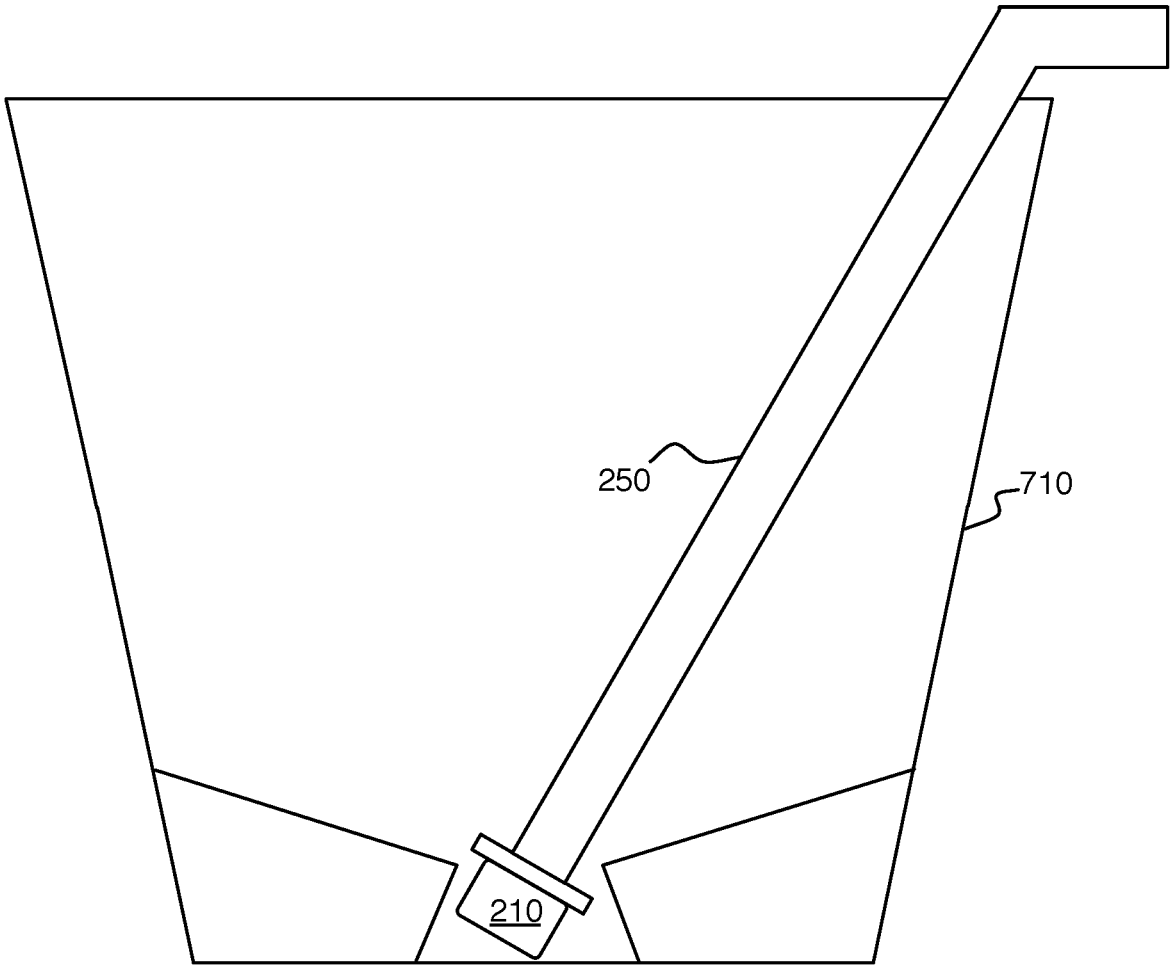
FIG. 7 illustrates a further example of an intake nozzle in use with a further exemplary bucket in accordance with the present invention.

FIG. 7 illustrates one example of a nozzle 210 inserted into a recess with the pipe 250 of the power painting system leaned against a sidewall of bucket 710. By selecting appropriate dimensions for a recess, a cylindrical recess may be sufficiently larger than the diameter of nozzle 210 to permit the power painting system to lean while nozzle 210 remains within recess. In other examples of a conically shaped recess, the upper diameter of the recess may hold a nozzle securely but removably while the wider diameter of the bottom of the recess may permit the nozzle to lean and, along with the nozzle, the pipe 250 and other components of the power painting system.

Figure 8:
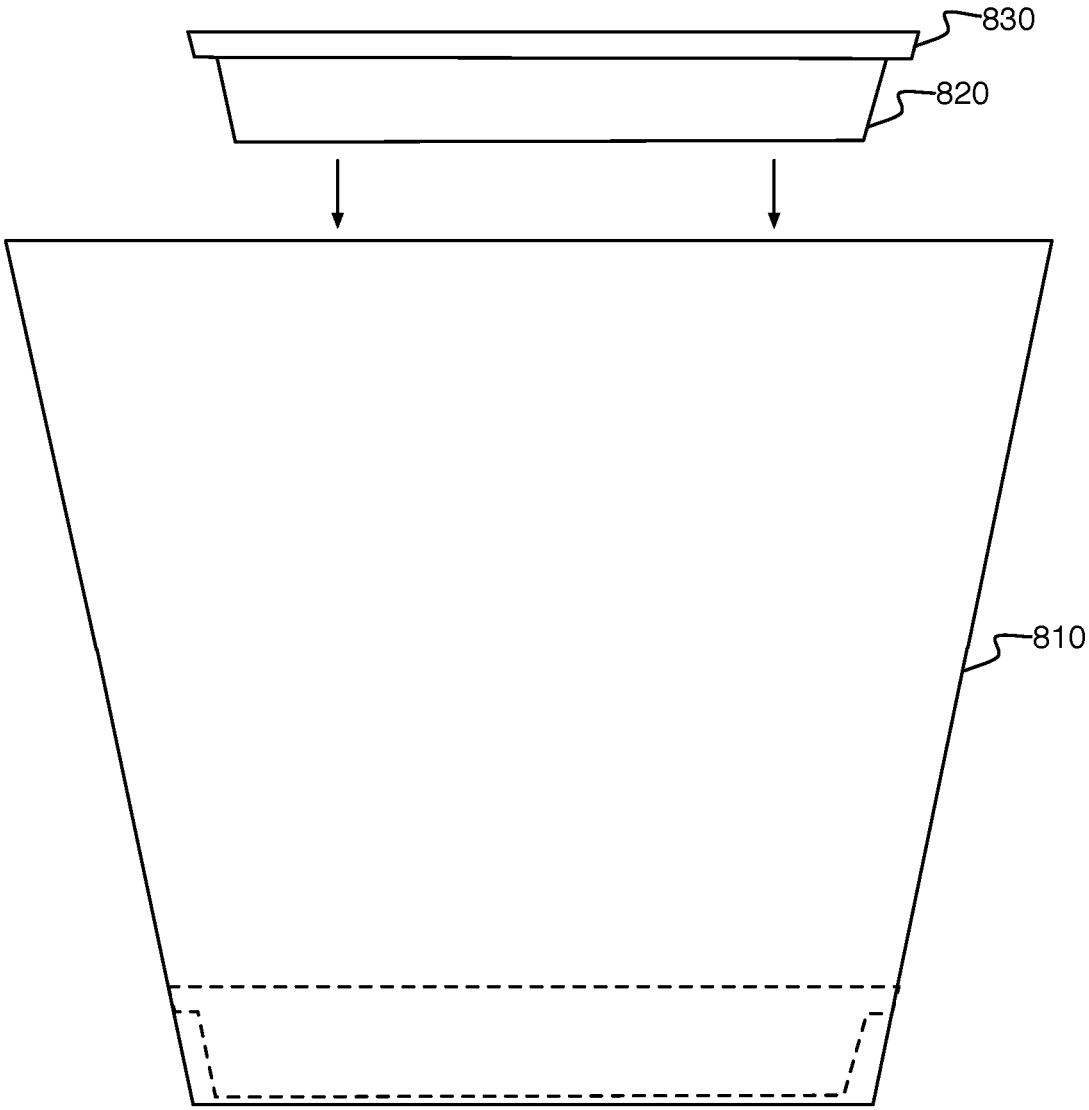
FIG. 8 illustrates an example of an insert that may be used to create an exemplary bucket in accordance with the present invention.

While funnel-bottomed paint buckets in accordance with the present invention may be constructed with a funnel portion integral to the bucket, in other examples a funnel-shaped bottom in accordance with the present invention may be inserted into pre-existing paint buckets (or other types of buckets) and, optionally, withdrawn and reused after painting with that bucket has been concluded. For example, as depicted in FIG. 8 a bucket 810 may receive a funnel-shaped assembly 820 having a seal 830 around a perimeter edge of the funnel-shaped bottom 820 to create a tight seal between the interior walls of bucket 820 and the funnel-shaped bottom 820. A seal 830 may comprise a silicone or rubber flange, a gasket, or any other structure that firmly contacts the interior sidewall of a bucket to prevent paint from leaking between the funnel-shaped bottom 820 and the sidewall of the bucket 810. In some examples, a seal 830 may be omitted entirely As shown in phantom, in manners similar to those described above, a funnel-shaped insertable bottom 820 may provide a recess and angled funnel sidewalls that direct paint to the recess when the funnel-shaped bottom 820 is installed within a bucket 810.

Systems and methods in accordance the present invention are not limited to any particular size or type of bucket or other paint container, nor are they limited to any given type of power painting system or nozzle assembly. Exemplary diameters for a top and/or bottom of a recess within a funnel bottom in accordance with the present invention may range from about 1.5 inches and 2.5 inches, although other dimensions may be used. In many examples, a power painter nozzle may have standardized dimensions and a funnel bottom for a paint bucket in accordance with the present invention may provide a recess having dimensions adapted to receive and retain standardized nozzles. In other examples, nozzles and recesses may be formed to more effectively mate during use. In some examples, polygon shaped recesses rather than circular recesses may be used, particularly if a polygon shaped nozzle is used. Further, the angle of the funnel wall may vary. The viscosity of different types of paint may differ and, accordingly, the angle of the funnel walls of a bottom in accordance with the present invention may be selected in order to encourage a wide range of viscosities of paint to flow into a provided recess for uptake by a power painter nozzle.

Whether formed as discrete funnel bottom for insertion into pre-existing paint buckets or formed as an integral paint bucket having a funnel-shaped bottom, the present invention may be formed using various types of materials using various fabrication techniques. In many examples, a plastic may be injection molded to form a bucket and/or funnel bottom for a bucket. In other examples, metals, nylons, resins, and other materials may be used to form systems in accordance with the present invention through molding, casting, machining, or any other technique.

The invention claimed is:

1. A paint bucket system, the paint bucket system comprising:

a funnel-bottomed bucket, wherein the funnel-bottomed bucket further comprises a bucket top diameter and a bucket bottom diameter;

a bucket interior that may contain a volume of paint;

a power painter, the power painter further comprising an intake nozzle;

a recess at the bottom of the bucket interior, the recess receiving the intake nozzle of the power painter, wherein the recess further comprises a truncated conical shape such that a recess top diameter is less than a recess bottom diameter, wherein the recess further comprises a recess height configured to detachably retain the intake nozzle of the power painter, and wherein an intake nozzle diameter is less than the recess top diameter; and a funnel bottom with sloping wall that cause paint to flow into the recess as a level of paint within the bucket lowers due to paint begin withdrawn by the intake nozzle.

2. The paint bucket system of claim 1, wherein the recess comprises truncated cone recess that detachably retains the intake nozzle, and wherein the recess bottom diameter is sufficiently larger than the intake nozzle diameter to permit the intake nozzle to be oriented at an angle other than substantially vertical.

3. The paint bucket system of claim 2, wherein the recess top diameter is between 1.5 inches and 2.5 inches, and wherein the recess bottom diameter is between 1.5 inches and 2.5 inches.

4. The paint bucket system of claim 3, wherein the truncated cone recess permits a detachably retained intake nozzle to tilt within the recess.

5. The paint bucket system of claim 4, further comprising an insertable bottom, the insertable bottom containing the recess and the funnel bottom, the insertable bottom being insertable into and removable from the interior of the paint bucket.

6. The paint bucket system of claim 5, wherein the insertable bottom further comprises a seal that prevents paint from the interior of the paint bucket from passing below the inserted insertable bottom.

7. An insertable bottom system for a paint bucket, the insertable bottom system comprising:

a power painter, the power painter further comprising an intake nozzle;

a recess, wherein the recess further comprises:

a truncated conical shape such that a recess top diameter is less than a recess bottom diameter, wherein the recess being configured to receive the intake nozzle of the power painter;

a recess height being configured to detachably retain the intake nozzle of the power painter; and an intake nozzle diameter less than the recess top diameter; and angled funnel walls that slope at an angle toward the recess, and wherein the insertable bottom may be detachably inserted into a flat bottomed bucket to direct paint within the interior of the bucket into the recess of the insertable bottom as paint is withdrawn from the interior of the bucket by the intake nozzle of the power painter.

8. The insertable bottom system for a paint bucket of claim 7, further comprising a seal that prevents paint from leaking below the insertable bottom when it is inserted into a flat bottomed bucket.

9. The insertable bottom system for a paint bucket of claim 8, wherein the recess comprises a truncated cone having a top diameter between 1.5 inches and 2.5 inches, and wherein having a bottom diameter between 1.5 inches and 2.5 inches.

10. The insertable bottom system for a paint bucket of claim 9, wherein the recess permits the intake nozzle to tilt while paint is withdrawn from the interior of the bucket.

11. The insertable bottom system for a paint bucket of claim 7, further comprising a flare sided sidewall such that a bucket top diameter is greater than a bucket bottom diameter.

12. The paint bucket system of claim 1, further comprising a flare sided sidewall such that the bucket top diameter is greater than the bucket bottom diameter.

13. A paint bucket system, the bucket system comprising:

a power painter, the power painter further comprising an intake nozzle;

a bucket interior that may contain a volume of paint;

a recess at the bottom of the bucket interior, the recess receiving the intake nozzle of the power painter, wherein the recess further comprises a truncated conical shape such that a recess top diameter is less than a recess bottom diameter, wherein the recess further comprises a recess height configured to detachably retain the intake nozzle of the power painter, and wherein an intake nozzle diameter is less that the recess top diameter; and a funnel bottom with sloping wall that cause paint to flow into the recess as a level of paint within the bucket lowers due to paint begin withdrawn by the intake nozzle; and a flare sided sidewall such that a bucket top diameter is greater than a bucket bottom diameter.

* * * * *